US005764133A

United States Patent [19]

Pullins et al.

[11] Patent Number: 5,764,133

[45] Date of Patent: Jun. 9, 1998

[54] ANTI-ROBBERY SECURITY SWITCH SYSTEM

[76] Inventors: Leonard M. Pullins; Dorothy M. Pullins, both of 137 Rose St., #1207, Lexington, Ky. 40507

[21] Appl. No.: 759,016

[22] Filed: Dec. 2, 1996

[51] Int. Cl.[6] ..... G08B 13/00

[52] U.S. Cl. ..... 340/331; 340/573; 340/574; 235/7 R; 235/23; 109/2; 109/21; 109/38

[58] Field of Search ..... 340/331, 332, 340/333, 573, 574, 570, 691; 235/7 R, 23; 109/2, 10, 21, 31, 38

[56] References Cited

U.S. PATENT DOCUMENTS

| | | | |
|---|---|---|---|
| 3,587,082 | 6/1971 | Moehter | 340/276 |
| 3,618,060 | 11/1971 | Nina | 340/224 |
| 3,725,893 | 4/1973 | Malta et al. | 340/280 |
| 3,828,166 | 8/1974 | Johansson | 235/7 A |
| 4,035,792 | 7/1977 | Price et al. | 340/277 |
| 4,054,752 | 10/1977 | Dennis, Jr. et al. | 340/574 |
| 4,818,974 | 4/1989 | Fernandez | 340/574 |
| 4,855,723 | 8/1989 | Fritz et al. | 340/691 |
| 5,157,383 | 10/1992 | Fisher | 340/574 |

*Primary Examiner*—Edward Lefkowitz
*Attorney, Agent, or Firm*—Joseph N. Breaux

[57] ABSTRACT

A security switch system including a power supply; a first electrical contact switch; a second electrical contact switch; an electrical flash unit having a flash circuit including a flash emitting device that emits a flash of light of sufficient intensity to temporarily impair the vision of a viewer; and a switching relay having first and second alternating current switching contacts installable in series within the main alternating current power input to a building. Actuation of either or both the first and second electrical contact switch causes the flash unit to emit a blinding flash of light while the switching relay simultaneously disconnects all power to the building including the ambient lights. The robber is thus exposed to a high intensity flash of light while being simultaneously plunged into a dark environment.

4 Claims, 1 Drawing Sheet

ANTI-ROBBERY SECURITY SWITCH SYSTEM

TECHNICAL FIELD

The present invention relates to devices utilized by victims of robberies to protect their lives and property and more particularly to a security switch system that is actuated by operation of either, or both, of two actuation devices that activate a short duration high intensity light emitting device and simultaneously cuts electrical power to the entire building in which it is installed.

BACKGROUND ART

It can be difficult and dangerous to attempt to disarm or otherwise disable a robber during the course of a robbery at a store or other public facility. The robber is typically armed with a weapon, such as a gun, and typically watches the clerk intently as the robbery takes place. It would be a benefit, therefore, if the victim had an easily and inconspicuously activated mechanism for disabling the robbers vision so that the victim could escape from the range of control of the robber safely. It would be a further benefit if the vision disabling mechanism had at least two vision disabling components in order to increase the effectiveness of the vision disabling system. In addition, it would be a still further benefit if the two vision disabling components were complementary—with each component increasing the effectiveness of the other component.

GENERAL SUMMARY DISCUSSION OF INVENTION

It is thus an object of the invention to provide an anti-robbery security switch system that includes a vision disabling mechanisms for disabling the vision of a robber.

It is a further object of the invention to provide an anti-robbery security switch system that includes a vision disabling mechanisms for disabling the vision of a robber that disables the vision of the robber by operation of two separate vision disabling components.

It is a still further object of the invention to provide an anti-robbery security switch system that includes a vision disabling mechanisms for disabling the vision of a robber that disables the vision of the robber by operation of two separate vision disabling components that are complementary to each other.

Accordingly, an anti-robbery security switch system is provided. The security switch system includes a power supply having a first and second power terminal; a first electrical contact switch having first and second switch terminals, the first switch terminal being in electrical connection with the first power terminal; a second electrical contact switch having third and fourth switch terminals, the third switch terminal being in electrical connection with the first power terminal, the fourth switch terminal being in electrical connection with the second switch terminal; an electrical flash unit having first and second flash control inputs in electrical connection across the first and second switch terminals, first and second flash unit power inputs in connection between the first and second power terminals, a flash circuit having a flash emitting device that emits a flash of light of sufficient intensity to temporarily impair the vision of a viewer of the flash of light in response to a first predetermined flash control input signal across the first and second flash control inputs; and a switching relay having first and second alternating current switching contacts and first and second control coil terminals, the first control coil terminal being in electrical connection with the second and fourth switch terminal, the second control coil terminal being in electrical connection with the second power terminal, the first and second alternating current switching contacts being installable in series within the main alternating current power input to a building, the first and second alternating current switching contacts being separated when a control coil in electrical connection between the first and second control coil terminals is electrically energized. The first electrical contact switch is preferably installed within the money compartment of a cash register. The second electrical contact switch is preferably a floor mounted switch mounted to the floor beneath a cash register.

In a preferred embodiment, the first and second electrical contact switches are momentary contact switches and the switch system further includes a timer circuit having first and second timer control inputs in electrical connection across the first and second switch terminals, and a relay control circuit responsive to a second predetermined relay control input signal across the first and second timer control inputs that provides a conducting path across first and second timer relay terminals for a predetermined period of time after detecting the presence of the second predetermined relay control input signal, the first and second timer relay terminals being in electrical connection across the first and second switch terminals.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
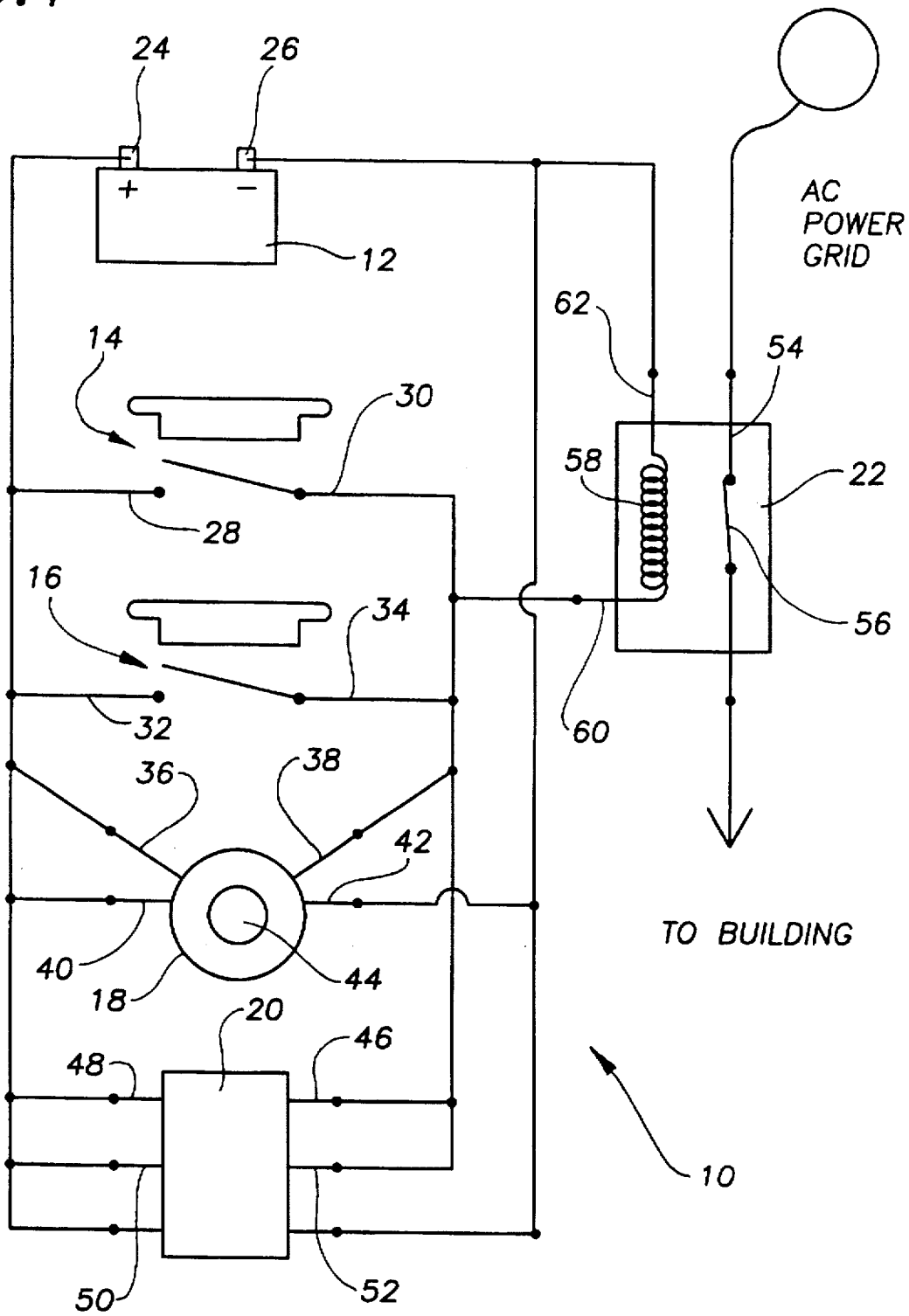
FIG. 1 is a schematic view of a preferred embodiment of the anti-robbery security switch system of the present invention showing the battery, the first and second electrical contact switches, the flash unit, the timer circuit, and the switch relay.

FIG. 1 is a schematic diagram of an exemplary embodiment of the security switch system of the present invention generally designated by the numeral 10. Switch system 10 includes a battery power supply 12; a first electrical momentary contact switch, generally designated by the numeral 14; a second electrical momentary contact switch, generally designated by the numeral 16; an electrical flash unit 18; a timer circuit 20; and a switching relay 22.

Battery power supply is a conventional twelve volt, wet cell battery having a positive terminal 24 and a negative terminal 26. First electrical contact switch 12 is a normally open, momentary contact switch having first switch terminal 28 in electrical connection with positive terminal 24 and a second switch terminal 30. Second electrical contact switch 16 is also a normally open momentary contact switch. Second electrical contact switch 16 has a third switch terminal 32 wired in electrical connection with positive terminal 24 and a fourth switch terminal wired in electrical connection with second switch terminal 30.

Electrical flash unit 18 is a conventional camera type flash unit commonly known in the art having first and second flash control inputs 36,38 in electrical connection across first and second switch terminals 28,30. Power is supplied through first and second flash unit power inputs 40,42 in connection between positive terminal 24 and negative terminal 26 of battery power supply 12. Flash unit 18 includes a flash circuit having a flash bulb 44 that emits a blinding flash of light in response to sensing zero volts across first and second flash control inputs 36,38. Thus when either first or second electrical contact switches 14,16 are depressed, flash circuit 18 causes flash bulb 44 to flash.

Timer circuit 20 is a conventional, normally open, timed relay commonly known in the art that closes for a predetermined period of time in response to detecting a zero voltage level across first and second timer control inputs 46,48. In this embodiment, first and second timer control inputs 46,48 are electrically connected across first and second switch terminals 28,30. Timer control circuit includes a relay control circuit that provides a conducting path between first and second timer relay terminals 50,52 for a three minute period when a zero voltage level across first and second timer control inputs 46,48.

Switching relay 22 is a normally closed, high power switching relay commonly known in the art. Switching relay 22 includes first and second alternating current switching contacts 54,56 that are wired in series to the incoming electric power lines of the building. Contact between first and second alternating current switching contacts 54,56 is broken by energizing a first control coil 58 having first and second control coil terminals 60,62. First control coil terminal 60 is wired to second and fourth switch terminals 30,34. Second control coil terminal 62 is wired to negative battery terminal 26. Thus a conducting circuit is established through control coil 58 and battery power supply 12 when either the first or second electrical contact switches 14,16 are closed or a conducting path is established between first and second timer relay terminals 50,52.

Use of the anti-robbery security control switch 10 is simple. When confronted with a robber, the victim simply depresses either or both the first or second electrical contact switches 14,16. Flash unit 18 detects the depression of either or both the first or second electrical contact switches 14,16 and causes flash bulb 44 to emit a blinding flash. Timer circuit 20 simultaneously detects the same depression of either or both the first or second electrical contact switches 14,16 and establishes a conducting path between first and second timer relay terminals 50,52 for a three minute period. With the conducting path established, first control coil 58 is energized breaking contact between first and second alternating current switching contacts 54,56 interrupting power to the building including all lights. The robber is thus subjected to a blinding flash of light while being simultaneously plunged into an unlit environment. This allows the victim an opportunity to flee the zone of control of the robber.

It can be seen from the preceding description that an anti-robbery security switch system that includes a vision disabling mechanisms for disabling the vision of a robber has been provided that includes a vision disabling mechanisms that disables the vision of the robber by operation of two separate vision disabling components that are complementary to each other.

It is noted that the embodiment of the an anti-robbery security switch system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An anti-robbery security switch system comprising:

a power supply having a first and second power terminal;

a first electrical contact switch having first and second switch terminals, said first switch terminal being in electrical connection with said first power terminal;

a second electrical contact switch having third and fourth switch terminals, said third switch terminal being in electrical connection with said first power terminal, said fourth switch terminal being in electrical connection with said second switch terminal;

an electrical flash unit having first and second flash control inputs in electrical connection across said first and second switch terminals, the electrical flash unit also having first and second flash unit power inputs in connection between said first and second power terminals, a flash circuit having a flash emitting device that emits a flash of light of sufficient intensity to temporarily impair the vision of a robber of said flash of light in response to a first predetermined flash control input signal across said first and second flash control inputs when either of the first or second electrical contact switches are depressed; and a switching relay having first and second alternating current switching contacts and first and second control coil terminals, said first control coil terminal being in electrical connection with said second and fourth switch terminal, said second control coil terminal being in electrical connection with said second power terminal, said first and second alternating current switching contacts being installable in series within the main alternating current power input to a building including all buildings lights, said first and second alternating current switching contacts being separated when a control coil in electrical connection between said first and second control coil terminals is electrically energized, when either of the first or second electrical contact switches are depressed, such that power to the building, including all building lights, is disconnected so the robber is exposed to a flash of light while simultaneously being plunged into a dark environment.

2. The anti-robbery security switch system of claim 1, wherein:

said first and second electrical contact switches are momentary contact switches, and said system further includes:

a timer circuit having first and second timer control inputs in electrical connection across said first and second switch terminals, and a relay control circuit responsive to a predetermined relay control input signal across said first and second timer control inputs that provides a conducting path across first and second timer relay terminals for a predetermined period of time after detecting said predetermined relay control input signal, said first and second timer relay terminals being in electrical connection across said first and second switch terminals.

3. The anti-robbery security switch system of claim 1, wherein:

said first electrical contact switch is installed within a money compartment of a cash register; and said second electrical contact switch is a floor mounted switch.

4. The anti-robbery security switch system of claim 3 wherein:

said first and second electrical contact switches are momentary contact switches, and said system further includes:

a timer circuit having first and second timer control inputs in electrical connection across said first and second switch terminals, and a relay control circuit responsive to a predetermined relay control input signal across said first and second timer control inputs that provides a conducting path across first and second timer relay terminals for a predetermined period of time after detecting said predetermined relay control input signal, said first and second timer relay terminals being in electrical connection across said first and second switch terminals.

* * * * *